US005886716A

United States Patent [19]

Heinzl et al.

[11] Patent Number: 5,886,716

[45] Date of Patent: Mar. 23, 1999

[54] METHOD AND APPARATUS FOR VARIATION OF INK DROPLET VELOCITY AND DROPLET MASS IN THERMAL INK-JET PRINT HEADS

[75] Inventors: Joachim Heinzl; Bernhard Hochwind, both of München; Alfred Zollner, Eitting, all of Germany

[73] Assignee: Eastman Kodak Company, Rochester, N.Y.

[21] Appl. No.: 506,736

[22] Filed: Jul. 26, 1995

[30] Foreign Application Priority Data

Aug. 13, 1994 [DE] Germany ..... 44 28 807.7

[51] Int. Cl.[6] ..... B41J 2/05

[52] U.S. Cl. ..... 347/48; 347/57; 347/62; 347/94

[58] Field of Search ..... 347/62, 57, 48, 347/94, 67, 60, 15

[56] References Cited

U.S. PATENT DOCUMENTS

| | | | |
|---|---|---|---|
| 4,251,824 | 2/1981 | Hara | 347/48 X |
| 5,481,287 | 1/1996 | Tachihara | 347/62 |

FOREIGN PATENT DOCUMENTS

| | | | |
|---|---|---|---|
| 0 354 982 | 2/1990 | European Pat. Off. | B41J 2/005 |
| 0 372 097 | 6/1990 | European Pat. Off. | B41J 2/05 |
| 0 373 894 | 6/1990 | European Pat. Off. | B41J 2/205 |
| 55-132259 | 10/1980 | Japan . | |
| 62-035852 | 2/1987 | Japan | B41J 3/04 |
| 62-169657 | 7/1987 | Japan | B41J 3/04 |
| 62-261452 | 11/1987 | Japan . | |
| 62-261453 | 11/1987 | Japan | B41J 3/04 |
| 1-237152 | 9/1989 | Japan | B41J 3/04 |
| 6-206311 | 7/1994 | Japan | B41J 2/05 |
| WO 87/03363 | 6/1987 | WIPO | G01D 15/16 |

*Primary Examiner*—Joseph Hartary
*Attorney, Agent, or Firm*—Walter S. Stevens

[57] ABSTRACT

Variation of ink droplet velocity and droplet mass in thermal ink-jet print heads having at least one primary heater element is achieved by means of a circuit for generating time-shifted heating pulses. The heater element structure is such that there is at least one secondary heater element in addition to and physically separated from each primary heater element. The circuit for generating time-shifted heating pulses for the primary and secondary heater elements applies those pulses in such a way that a vapor bubble has already formed in the printing fluid on the secondary heater element at the point at which a vapor bubble starts to form in the printing fluid on the primary heater element.

5 Claims, 5 Drawing Sheets

Fig. 5
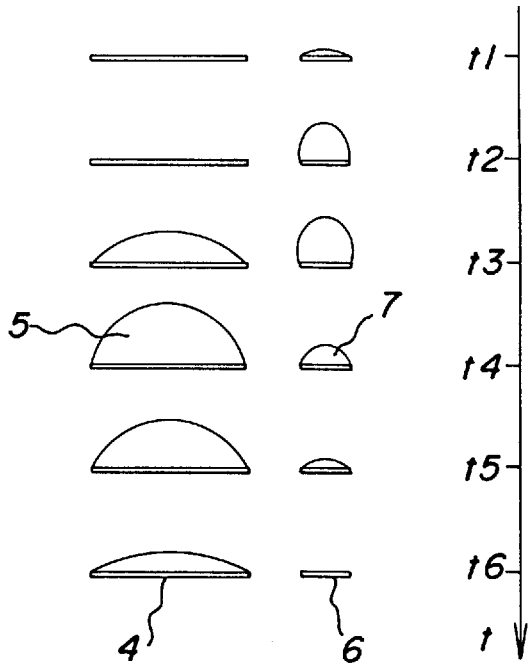
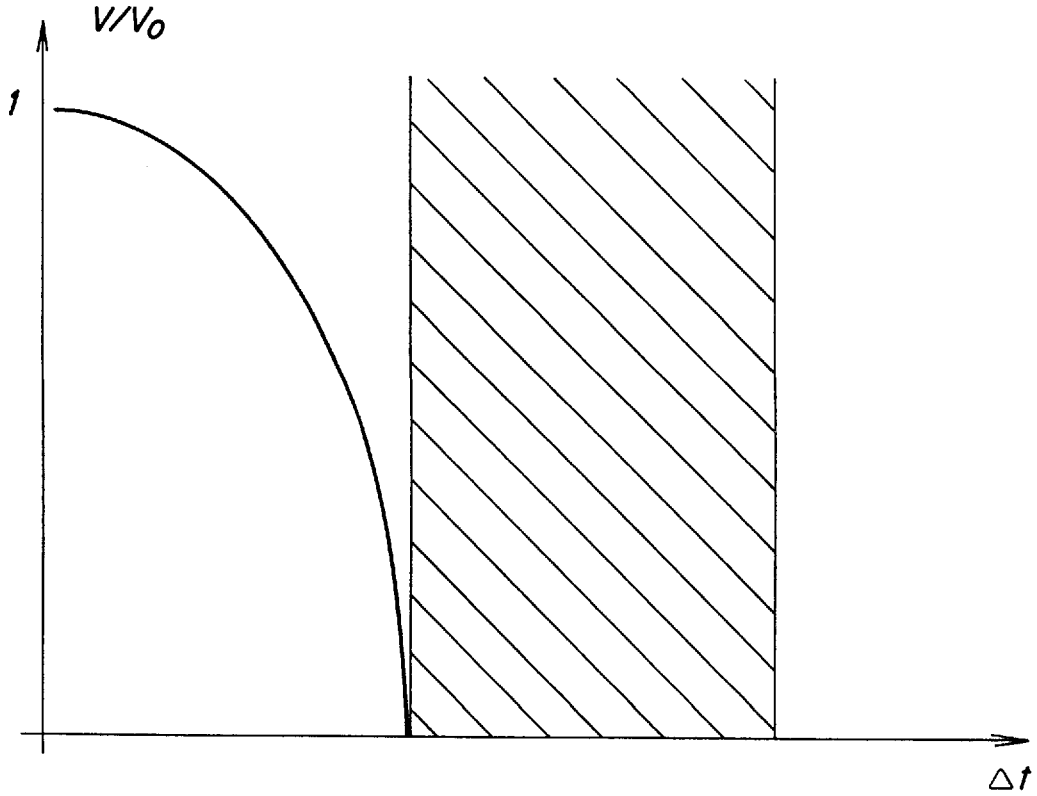
Fig. 6

METHOD AND APPARATUS FOR VARIATION OF INK DROPLET VELOCITY AND DROPLET MASS IN THERMAL INK-JET PRINT HEADS

TECHNICAL FIELD

The invention relates to an ink jet printer, and more particularly to an apparatus for varying ink droplet velocity and droplet mass in thermal ink-jet printers having at least one heater element in contact with a printing fluid and a circuit for generating time-shifted heating pulses.

BACKGROUND ART

In order to produce halftone images with ink-jet printers, dots of varying diameter must be created on the surface being printed. The state of the art offers various methods of achieving this object.

WO 87/03363 describes a method and an apparatus for creating halftone images with eight shades in which the ink droplets produced vary according to a binary ratio of their weights. The print head is constructed in such a way that for each color of ink there are orifies whose diameters vary according to the ratio of, say, 1:2:4. The corresponding heater elements vary by approximately the same ratio. The orifices are controlled in such a way that the combination used ejects the required mass of ink to produce the size of dot desired on the surface being printed. In order to produce a halftone image, each row of orifices requires a further two orifices in order to achieve the eight shades referred to above. The number of heater elements also increases correspondingly.

EP-A-0 373 894 describes a method and an apparatus for creating halftone images. This involves passing two consecutive current pulses through a heater element in a print head. The first pulse is used to heat the ink, while the second is used to create a vapor bubble which then forces an ink droplet out of the ejection orifice. The degree by which the ink is preheated determines the mass of ink ejected by the second pulse. A similar method is described in EP-A-0 354 982. In the latter case, the initial pulses used to heat the ink are generated in various different ways. This might involve a single pulse of long duration or a number of separate short pulses. The amount of energy transmitted to the ink by the pulses determines the mass of the ink droplet.

European patent application EP-A-0 372 097 describes an apparatus for creating ink droplets of varying sizes in an ink-jet printer according to the thermal converter principle. This involves matching the control pulses to the geometry of the thermal converter. The thermal converters are divided into a number of heater sections (W1 . . . W3) of varying width (bi), thickness (di) or material ((I, ai). The heterogeneity of the heater elements means that certain heater element sections heat up faster than others. Those sections which heat up more slowly are used to heat the ink while those which heat up quickly are used to produce vapor bubbles.

DISCLOSURE OF THE INVENTION

The object of the present invention is to create an apparatus capable of varying ink droplet mass to a degree beyond that achieved by conventional methods by using several heater elements for each ink channel. This provides the ability to control ink droplet velocity and droplet mass independently of one another.

Another object of the invention is to create a means of controlling the apparatus concerned which is capable of fully utilizing its ability to produce halftone images.

The invention achieves this by having at least one secondary heater element in addition to and physically separated from at least one primary heater element, and by the fact that the circuit for generating time-shifted heating pulses allows the primary and secondary heater elements to be controlled in such a way that a printing fluid vapor bubble has already formed on the secondary heater element at the point when the printing fluid vapor bubble on the primary heater element is just starting to form.

The advantage of the apparatus according to the invention is that the ink droplet velocity in ink-jet printers of the bubble-jet type can be adjusted independently of the droplet mass required.

In addition, the method according to the invention is suitable for producing ink droplets of extremely small mass which in particular results in a very high-resolution printed image (near photograph quality).

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 5 is the stages of bubble formation on the primary and secondary heater elements;

FIG. 6 is the relative ink droplet mass as compared to the time shift between primary and damping bubble;

DETAILED DESCRIPTION OF THE INVENTION

The description of the invention which follows does not include details of the design of an ink-jet print head since the method and the apparatus according to the invention can both be used in the types of print head adequately described by the state of the art. Examples of descriptions of designs for ink-jet print heads can be found in the publications DE-A-28 43 064, DE-A-30 12 698, DE-A-40 40 713, EP-A-0 438 295, EP-A-0 537 880 and FP-A-0 521 634.

Figure 1A:
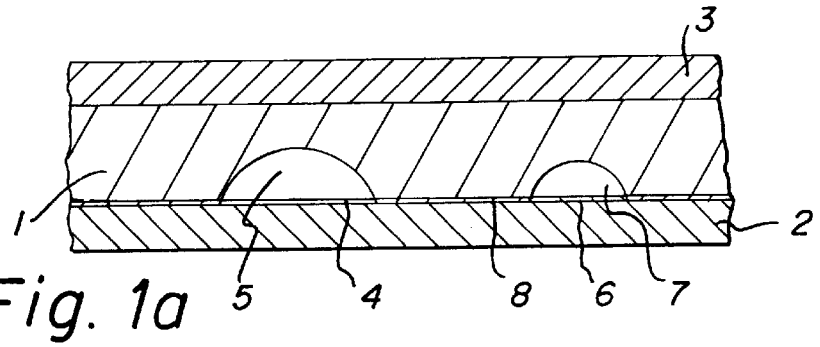
FIG. 1*a* is a cross section of an ink channel of in ink-jet printing head.
Figure 1B:
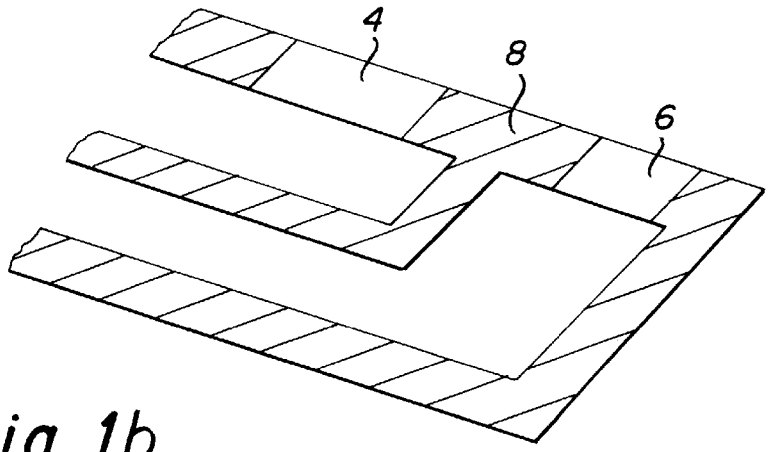
FIG. 1*b* is a three-quarter view corresponding to FIG. 1*a* and showing the arrangement of the heater elements and the electrical conductors.

FIGS. 1*a* and 1*b* show a cross section through an ink channel in a print head which is filled with printing fluid 1.

The ink channel has a lower and an upper bounding surface 2 and 3. Attached to the lower bounding surface 2 are a primary heater element 4 and a secondary heater element 6. The lower bounding surface also carries the conductors 8 for the power supply to the heater elements 4, 6. The heater elements 4, 6 are arranged on the lower bounding surface of the ink channel so as to be physically separated from one another. When an electric current is passed through the heater elements 4, 6, a primary vapor bubble 5 is formed directly on top of the primary heater element 4 and a damping bubble 7 on top of the secondary heater element 6.

Figure 2:
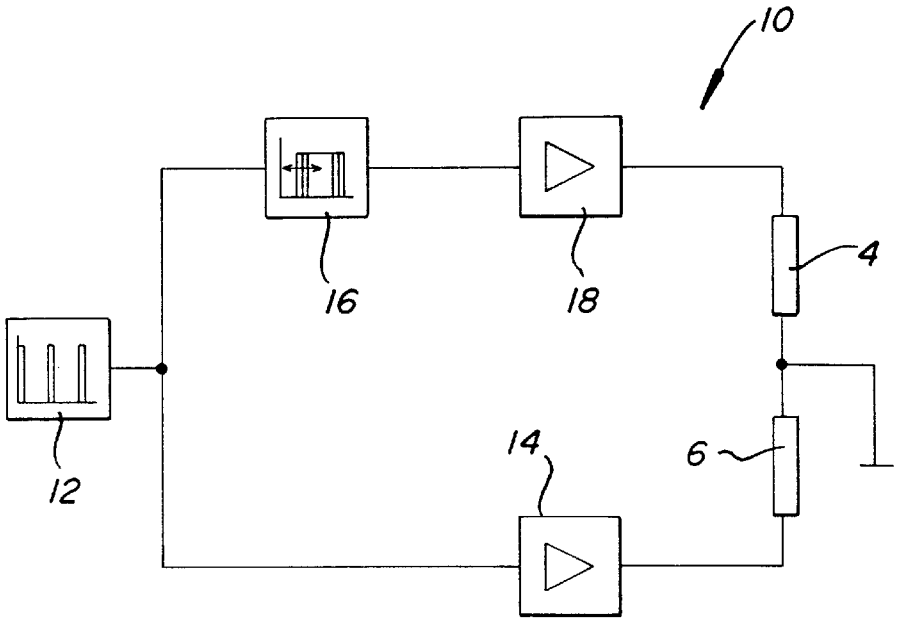
FIG. 2 is a schematic diagram of the circuit for operating the heater element arrangement shown in FIGS. 1*a* and 1*b*.

A schematic diagram of a circuit 10 for controlling the heater elements 4, 6 is shown in Fig. 2. A pulse generator 12 provides a continuous supply of pulses. Those pulses are transmitted to the secondary heater element 6 via a power amplifier 14. Connected between the pulse generator and the primary heater element 4 are a time delay element 16 and a power amplifier 18. The effect obtained by this arrangement is that the primary heater element receives its pulses later than the secondary heater element 6.

Figure 3:
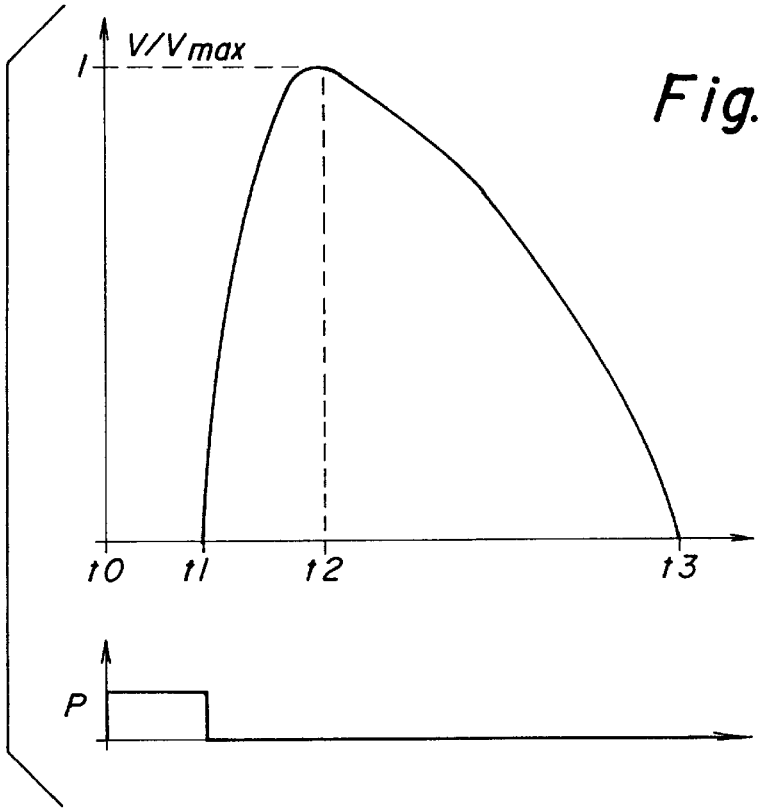
FIG. 3 is the graph of the volume over time of a vapor bubble produced by a single heater element.

The formation of a vapor bubble over time is shown in graph form in FIG. 3. The corresponding pulse progression over time for the heater element concerned is also shown. At the time $t_0$ the current is applied to the heater element and continues to flow until formation of a vapor bubble begins at the time $t_1$. At $t_1$ the heating pulse is switched off. At $t_2$ the vapor bubble reaches its maximum volume. From that point on it begins to collapse and has completely collapsed by $t_3$.

Figure 4:
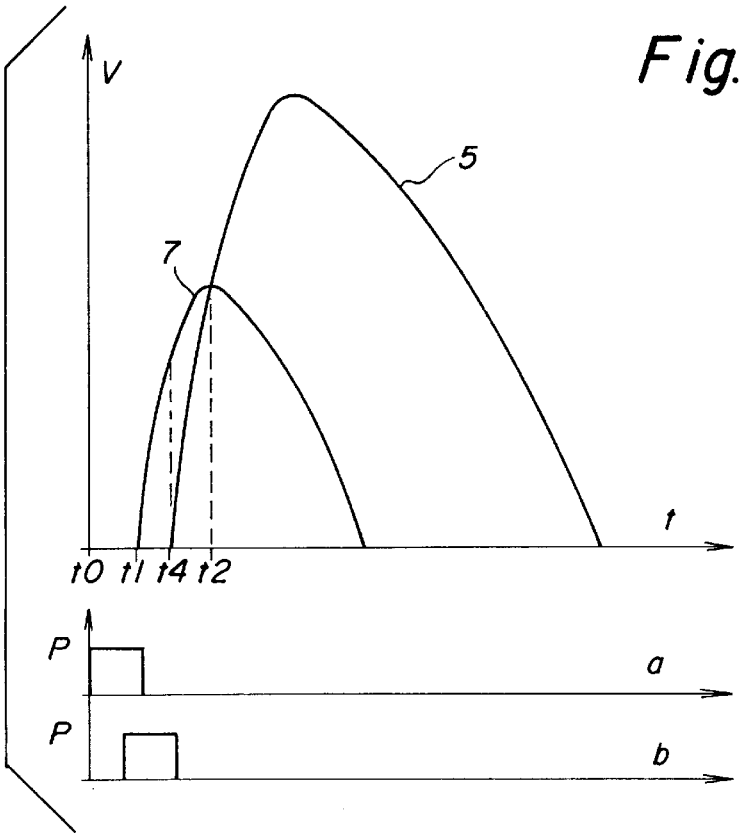
FIG. 4 is the graphs of the volume over time of the primary and damping vapor bubbles produced by the apparatus shown in FIGS. 1*a* and 1*b*.

FIG. 4 shows the volumes of the vapor bubbles produced by the apparatus as per FIGS. 1*a* and 1*b*. At the time $t_o$ the heating current is applied to the secondary heater element 6. There is then a time delay from $t_o$ before the heating current is applied to the primary heater element 4. The damping bubble 7 which forms on the secondary heater element 6 reaches its maximum volume at the time $t_2$. The primary vapor bubble 5 starts to form on the primary heater element 4 at the time $t_4$ between the points $t_1$ and $t_2$. Thus the point at which the primary vapor bubble starts to form falls within the period when the damping bubble 7 is growing. If $t_4$ and $t_2$ coincide, the maximum damping effect is obtained and under ideal circumstances no ink droplet is ejected. This eventuality is best illustrated by FIG. 6. The shaded area represents the time delay during which no droplet is ejected. If, on the other hand, $t_4$ and $t_1$ coincide, the effect of the two vapor bubbles is cumulative and maximum droplet velocity is obtained. FIG. 6 shows this situation if the time delay between $t_1$ and $t_4$ is zero. A clearer description of the various phases of bubble formation can be provided with the aid of FIG. 5. This provides a diagrammatic representation of the progression shown in graph form in FIG. 4 of bubble formation on the primary and secondary heater elements 4, 6 at the times $t_1$–$t_6$. At a damping bubble 7 starts to form on the secondary heater element 6 and at $t_6$ it has completely collapsed again. At $t_4$ the primary vapor bubble 5 reaches its maximum volume and starts to collapse again from that point on.

Figure 7:
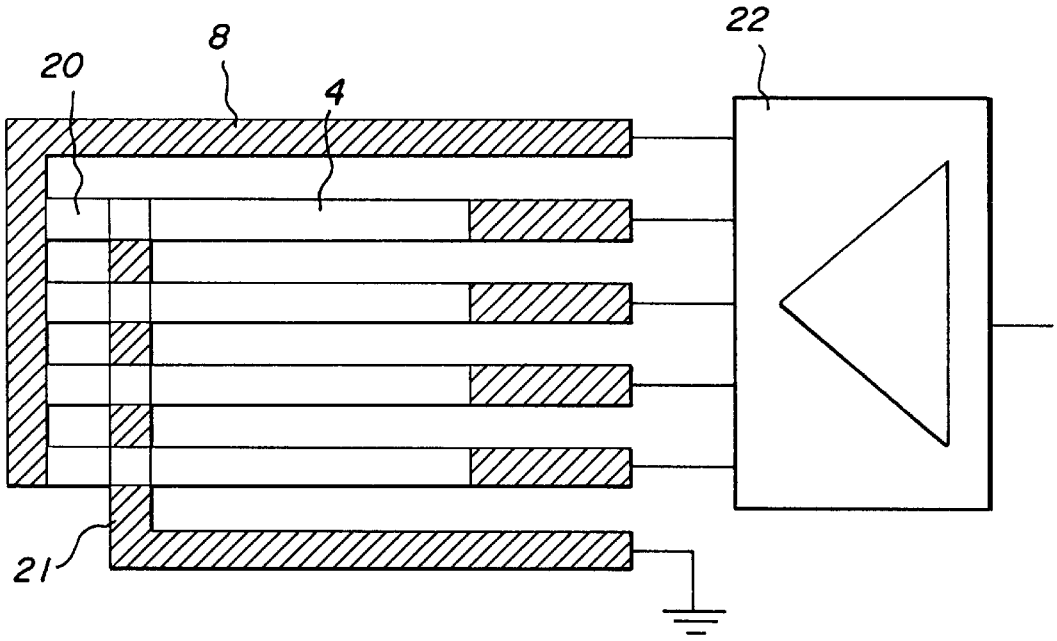
FIG. 7 is the circuit layout for the primary and pilot heater elements for four channels, the pilot heater elements being connected in parallel and collectively controlled.

FIG. 7 illustrates another preferred version of the present invention. In this case, there is a pilot heater element 20 for producing a pilot vapor bubble 25 directly adjacent to the primary heater element 4. The pilot vapor bubble 25 which forms on the pilot heater element 20 can therefore under certain circumstances overlap onto the primary heater element 4. These two heater elements 4, 20 form a continuous heating surface which is divided by a current tap 21 into two sections of any length. The pilot heater element 20 is usually the smaller section because the same electrical voltage will produce a greater heat output density with a smaller area which will result in more rapid bubble formation. An alternative to increasing the heat output density by reducing the heating surface area is to vary the thickness or the width of the pilot heater element 20. In theory it is also possible to increase the power applied to the pilot heater element but in practice this is limited by the maximum permissible control voltage.

All n heater elements in a channel are connected by at least n+1 electrical conductors to an electronic control unit 22. That electronic control unit 22 may also take the form of an integrated circuit. Where several ink channels run parallel to one another (see FIG. 7), it is possible to use a common earth conductor for all heater elements. All heater elements can be operated independently of one another if the total number of electrical conductors is at least m·n+1 where m is the number of channels and n the number of heater elements per channel. Normally, however, the pilot heater elements 20 will be controlled collectively by means of common conductors as shown in FIG. 7, for example.

Figure 8:
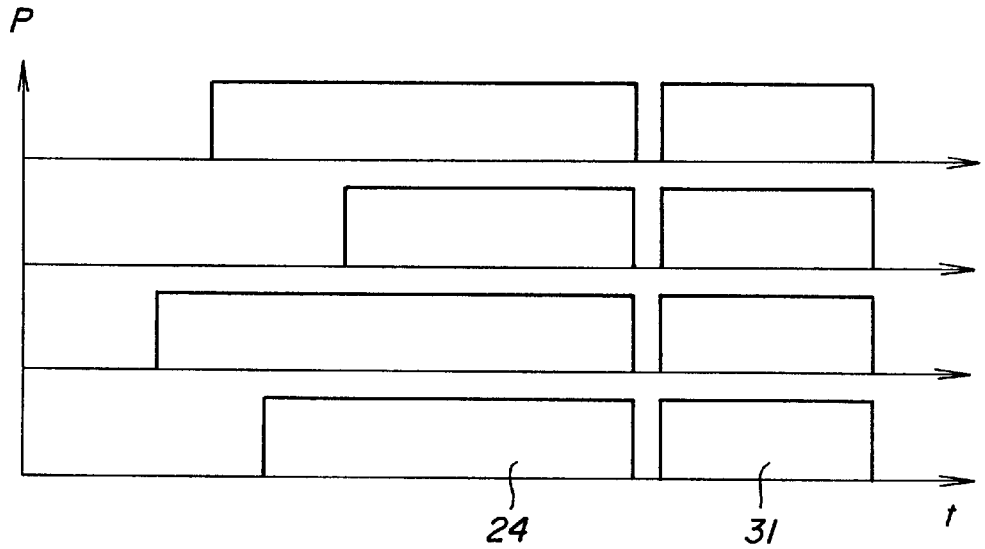
FIG. 8 is the possible activation frequency of the primary and pilot heater elements using the circuit arrangement shown in FIG. 7.

The progression over time of the current applied to the heater elements 4, 20 when using a pilot heater element 20 and a primary heater element 4 as per FIG. 7 is shown in FIG. 8. The current is applied to the primary heater elements 4 before it is applied to the pilot heater elements 20. The primary heating pulse 24 therefore appears before the pilot heating pulse 31. The graph shows the pulse progression for four channels. It is self evident that the number of channels is variable and depends on the design of the particular print head concerned. It can be clearly seen that the pilot heating pulses 31 for all pilot heater elements 20 are of identical intensity and duration.

Figure 9:
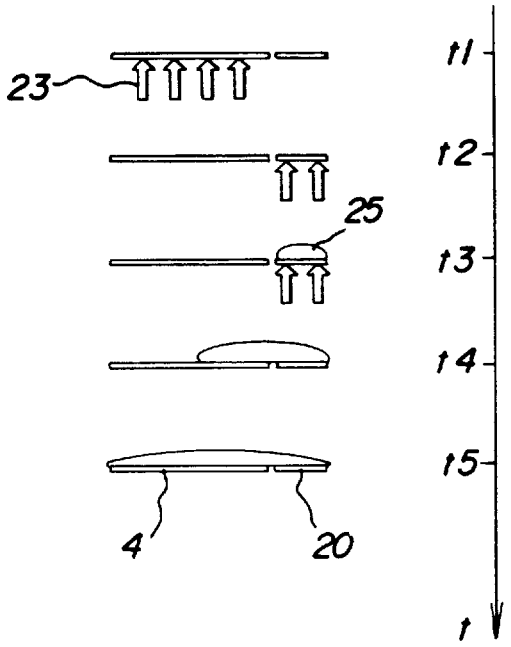
FIG. 9 is the stages of bubble formation on the primary and pilot heater elements.

The stages of bubble formation on the pilot and primary heater elements 4, 20 are shown in FIG. 9. At the time $t_1$, the current is applied to the primary heater element 4 and heats it to a specific heat output level 23. The physically adjacent pilot heater element 20 is heated at the point $t_2$. At $t_3$, a pilot vapor bubble starts to form which then extends across the heated surface of the primary heater element 4 over the period extending to $t_4$ and $t_5$. The level to which the primary heater element 4 has been preheated determines the mass of the ink droplet ejected from the orifice (not illustrated).

Figure 10:
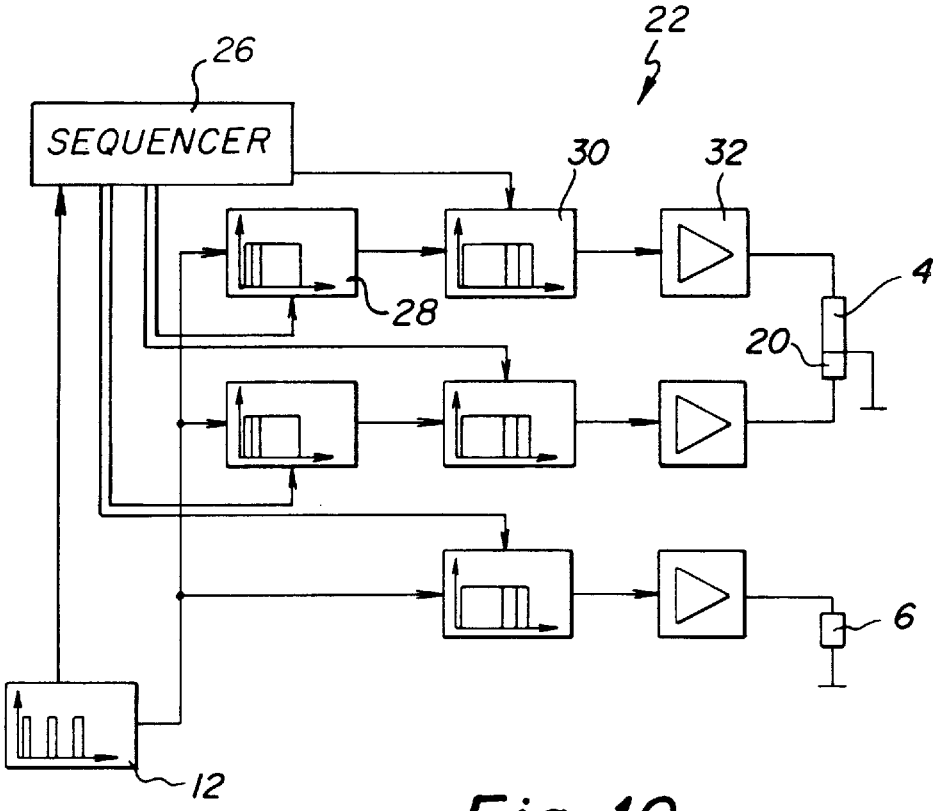
FIG. 10 is a schematic diagram of the circuit for operating a printing head with primary, secondary and pilot heater elements.

FIG. 10 shows a schematic diagram of a control circuit 22 for combining the principle of using a secondary heater element 6 as a damping element with that of using a pilot heater element 20. A pulse generator 12 provides a continuous supply of pulses which are delayed by time delay elements and the duration of which is controlled by a pulse duration timer 30. The pulses for the individual heater elements thus formed are passed via power amplifiers 32 to the primary, secondary and pilot heater elements 4, 6, 20 which then produce the required vapor bubbles. Time delay elements 28 are only used for the primary and pilot heater elements 4, 20. The pulse delay time and duration required to produce varying sizes of ink droplet is controlled by the sequencer 26.

The invention has been described in detail with particular reference to preferred embodiments thereof, but it will be understood that variations and modifications can be effected within the spirit and scope of the invention.

We claim:

1. In a thermal ink-jet print head device having a primary heater element for heating a printing fluid, a drop variation control system comprising;

a secondary heater element physically separated from the primary heater element;

circuit means for applying heating current pulses to said primary and secondary heater elements, said circuit means including pulse control means for selectively effecting heating of said secondary heater elements at different time periods before the heating of said primary heating elements so as to selectively vary drop ejection velocity; and a pilot heater element adjacent said primary heater element and pilot circuit means for applying a heating current pulse to said pilot heater element for triggering vaporization above both said primary and pilot heater elements.

2. A print head device as set forth in claim 1, wherein said pulse control means includes means for varying the delay of energization pulses for said primary heating means to vary drop ejection velocity.

3. A print head device as set forth in claim 1, wherein said circuit means includes drop size regulator means for regulating the time period according to which said primary heater element is energized prior to energization of said pilot heater element.

4. A method of varying ink droplet velocity in thermal ink-jet print heads having at least one primary heater element in contact with a printing fluid and having a circuit for generating a series of drop ejection heating pulses, said method comprising the steps of:

providing a secondary heater element spaced from said primary heater element and having associated energization circuitry; applying current to said secondary heater element at a time $t_o$ so that a vapor bubble starts to form at time $t_1$ and reaches its maximum volume at time $t_2$;

applying current to said primary heater element at a time which differs from $t_0$ by virtue of a time delay, so that a primary vapor bubble starts to form at time $t_4$ which falls between the times $t_1$ and $t_2$;

ejecting ink droplets at varying velocities according to the relative position of $t_4$ between times $t_1$ and $t_2$;

providing a pilot heater element located adjacent said primary heater element and having associated energization circuitry; and applying current to said pilot heater element at a time selectively after current application to said primary heater element and in a manner such that a vapor bubble forms on the pilot heater element after predetermined preheating of the ink over the surface of the primary heater element whereby ejected ink drop mass is varied according to such preheating period.

5. In a thermal ink-jet print head device having a primary heater element, an improved drop ejection control system comprising:

(a) a damper bubble heater element spaced from said primary heater element;

(b) a pilot bubble heater element adjacent said primary heater element;

(c) electrode means for supplying different heating energy pulses respectively to said primary damper bubble and pilot bubble heater elements; and (d) heating pulse generator and control means for:

(i) providing a first heating energy pulse to said primary heater element during a first time period;

(ii) providing a second heating energy pulse to said damper bubble heater elements during a second time period commencing a predetermined time prior to the beginning of said first period to control drop ejection velocity; and (iii) providing a third heating energy pulse to said pilot bubble heater at a time predeterminedly after the beginning of said first period to control drop ejection size.

* * * * *